US006227208B1

(12) United States Patent
Imbert

(10) Patent No.: US 6,227,208 B1
(45) Date of Patent: May 8, 2001

(54) COMPACT WITH INSERTED DECORATED MIRROR

(75) Inventor: Jean-Paul Imbert, Englewood, NJ (US)

(73) Assignee: LIR-USA Manufacturing Co., Inc., Yaphank, NY (US)

( * ) Notice: Subject to any disclaimer, the term of this patent is extended or adjusted under 35 U.S.C. 154(b) by 0 days.

(21) Appl. No.: 09/401,906

(22) Filed: Sep. 23, 1999

Related U.S. Application Data

(60) Provisional application No. 60/103,338, filed on Oct. 7, 1998.

(51) Int. Cl.[7] ..... A45D 42/02; A45D 33/22

(52) U.S. Cl. ..... 132/304; 132/296; 132/301

(58) Field of Search ..... 132/304, 305, 132/293, 294, 295, 296, 314, 315, 316, 301

(56) References Cited

U.S. PATENT DOCUMENTS

| | | | | |
|---|---|---|---|---|
| 2,054,004 | | 9/1936 | Sandberg . | |
| 2,401,127 | | 5/1946 | Younghusband . | |
| 2,582,593 | | 1/1952 | Kramer . | |
| 3,911,936 | * | 10/1975 | Kingsford | 132/293 |
| 4,917,131 | * | 4/1990 | Contreras | 132/301 |
| 5,054,505 | | 10/1991 | Yuhara . | |
| 5,078,159 | | 1/1992 | Yuhara . | |
| 5,161,556 | | 11/1992 | Audebourg et al. . | |
| 5,199,451 | * | 4/1993 | MOntoli | 132/315 |
| 5,344,037 | | 9/1994 | Favre . | |
| 5,431,177 | * | 7/1995 | Keeman | 132/303 |
| 5,437,294 | | 8/1995 | Ebbets, III et al. . | |
| 5,655,553 | | 8/1997 | Giese et al. . | |
| 5,704,378 | * | 1/1998 | Machelett | 132/304 |
| 5,842,486 | * | 12/1998 | Davis et al. | 132/295 |
| 5,875,795 | * | 3/1999 | Bouix | 132/293 |
| 5,931,169 | * | 8/1999 | Kervoalen | 132/294 |
| 5,950,639 | * | 9/1999 | Suzuki et al. | 132/294 |
| 6,014,978 | * | 9/1999 | Yahara | 132/293 |

* cited by examiner

*Primary Examiner*—John J. Wilson
*Assistant Examiner*—Robyn Kieu Doan
(74) *Attorney, Agent, or Firm*—Cooper & Dunham LLP

(57) ABSTRACT

A compact for holding cosmetic material, having a transparent cover with a mirror initially separate from the lid to enable viewing of the contents at the point of purchase, the mirror being mountable in the cover by a user after purchase and having a decorative back visible through the transparent cover when the mirror is mounted in the cover.

11 Claims, 3 Drawing Sheets

COMPACT WITH INSERTED DECORATED MIRROR

CROSS REFERENCE TO RELATED APPLICATION

This application claims the priority benefit, under 35 U.S.C. §119(e) (1), of applicants' copending U.S. provisional application Serial No. 60/103,338, filed Oct. 7, 1998, which is incorporated herein in its entirety by this reference.

BACKGROUND OF THE INVENTION

This invention relates to compacts, and in an important specific sense is particularly directed to compacts for containing cosmetics for application by an end user.

For purposes of illustration, the invention will be described herein as embodied in compacts for cosmetics, it being understood, however, that its broader aspects the invention is not limited thereto but may be embodied in compacts for containing other types of materials as well.

Many cosmetics materials, including face powders, foundations, eye shadows, blushes, and some lipsticks and mascaras, are commonly placed (for retail sale and subsequent end use) in containers known as compacts. A conventional compact includes a base formed as a tray with one or more upwardly open recesses for holding the cosmetic material in compressed or like stable condition, and a cover for overlying the base and enclosing the tray to prevent the contents from drying out, becoming contaminated, spilling, or soiling outside objects. One or more brushes, pads such as powder puffs or other implements for applying the cosmetics may also be placed within the compact between the base and cover.

In these conventional compacts, the base and cover are typically molded of plastic or formed of metal, and are hinged together in clamshell fashion along one side of the compact, a manually operable latch being provided on the other side to hold them in closed position. The compact is dimensioned to be held in the hand, and may be square, rectangular, oval, circular, or of other regular or irregular shape. To apply the contained cosmetics, the user opens the compact, draws an applying implement (or a finger) across the cosmetic material held in a recess of the base tray to pick up some of the material, and conveys it on the implement to the appropriate facial area. Very advantageously, a mirror is provided within the inwardly facing surface of the cover so as to be visible by a user when the compact is open and the user is applying the cosmetic material to the face. Thus, the user can easily and accurately apply the cosmetic when no external mirror is available. The disposition of the mirror within the compact cover is an important feature of convenience in that it enables the user to hold and position both the exposed body of cosmetic material and the mirror in one hand while employing the other hand to manipulate the applicator.

It is frequently desirable to package a compact in a manner enabling retail customers to view the contained cosmetic material at the point of sale without exposing the material to contamination such as can occur if a compact is opened at a store by a prospective purchaser. Accordingly, the compact may be sealed in a transparent plastic film, e.g., in a blister package, with the cover opened to lie flat with the base so that the contents of the compact are clearly visible through the blister film. A problem with this type of packaging, however, is that the area of the package must ordinarily be at least twice the area of the closed compact, because the base and cover lie open at 180°, or approximately at 180°, to each other; hence the packages occupy undesirably large amounts of shelf or display space.

Expedients heretofore proposed to reduce the area occupied by compacts in blister-package or like displays have included the provision of special articulated hinges connecting the cover and base to enable the cover to turn 360° into a position underlying the base. These expedients are more or less structurally complicated, adding to manufacturing cost and complexity, and may present difficulties in manipulation for the end user.

Other possible arrangements for enabling point-of-purchase viewing of the contents of a compact would require elimination of the interior cover mirror with consequent loss of its beneficial attributes of ease and convenience in application of cosmetics.

SUMMARY OF THE INVENTION

An object of the invention is to provide a new and improved cosmetic material container of the type comprising a compact, enabling point-of-purchase visibility of the contained cosmetic in a manner that avoids the above-discussed difficulties. A particular object is to provide such a container enabling the cosmetic material to be visible at the point of purchase, and at the same time providing a mirror carried on the lid or cover of the compact and facing inwardly so that the user can conveniently view the mirror during application of the contained cosmetic.

To these and other ends, the present invention in a first aspect broadly contemplates the provision of a cosmetics container kit comprising a compact including a base for containing a quantity of cosmetic material and a transparent cover through which the contained cosmetic material can be viewed, and an insert member having a specularly reflective surface and manually mountable within the cover by a user to provide an inwardly-facing mirror for the compact.

Further in accordance with the invention, the insert member is opaque and advantageously has a decorative surface opposed to the reflective surface so as to be visible through the cover when the insert member is mounted within the cover. The insert member can be removably mountable within the cover, and the kit may include a plurality of the insert members, alternatively mountable within the cover and each having a specularly reflective surface and a decorative surface opposed thereto, the decorative surfaces of different insert members differing in appearance from each other. In addition, the kit may include an applicator positionable within the compact between the insert member and the contained cosmetic material when the insert member is mounted in the cover.

In particular, the invention is preferably embodied in a container for cosmetics comprising a compact having an exterior and an interior and including a base and a cover connected together in a manner permitting relative movement of the base and cover to open and close the compact, the base comprising a tray opening toward the interior of the compact for holding a quantity of the cosmetic material, the cover being transparent to enable the quantity of cosmetic material to be viewed therethrough when the compact is closed, and the cover having a surface facing the interior of the compact; an insert member, initially separate from the cover and base, having opposed extended surfaces and dimensioned to fit within the cover against the interior-facing surface thereof in overlying relation to a major portion of the latter cover surface, one of the extended surfaces of the insert member being specularly reflective, the insert member being manually fittable within the cover by a user; and retaining structure, including structure formed on the cover, providing snap-fitting interengagement between the insert member and the cover to hold the insert member securely within the cover when the insert member is manually fitted within the cover, with the specularly reflective surface facing the interior of the compact. Thereby, the specularly reflective surface constitutes a mirror, in the cover of the compact, visible when the compact is open to assist a user in the application of the contained cosmetic material. As herein used, the term "snap-fitting" embraces press-fitting and/or friction-fitting engagement securing elements (such as molded plastic elements) together when one is pressed or pushed into the other, such engagement being provided by appropriately shaped interfitting or interlocking structures molded integrally in one or both of the elements.

Advantageously, as a particular feature of the invention in currently preferred embodiments, the insert member has a peripheral edge and the retaining structure comprises projections formed integrally in the cover for snap-fittedly engaging the peripheral edge of the insert member.

In the container of the invention, the transparency of the cover enables point-of-purchase viewing of the contents of the compact with the compact closed (and thus occupying minimal shelf or counter area). Typically or conveniently, the insert member is packaged with the compact, located beneath the base so as not to interfere with the point-of-purchase viewing. A powder puff or other applicator separate from the base, cover and insert member can also be included within the same package and likewise located beneath the compact base. When the user opens the package, the insert member can be manually snap-fitted within the cover to serve as an inwardly-facing mirror similar in convenience to the mirrors of conventional compacts; and the applicator can be carried within the compact, between the inserted mirror and the contained cosmetic material. Thereby, without complex structural arrangements or excessive display area requirements, the objectives of point-of-purchase visibility of contents and provision of an inwardly-facing mirror are achieved.

The opacity and decorative outwardly-facing surface of the insert member, visible through the transparent cover of the compact, afford further features of advantage, especially from an aesthetic standpoint. As the compact is used, its interior with the contained applicator and partially consumed contents might be unsightly if visible through a transparent cover. Not only does the insert member conceal the compact interior, but in addition, the decorative insert surface seen through the cover contributes positively to the attractiveness of appearance of the compact. At the same time, the transparent cover provides a secondary function of protecting the decorative, visible outer surface of the insert member from being damaged by abrasion, scratches or the like.

Provision of two or more interchangeable mirror-bearing insert members, respectively having different ornamental or decorative outer surfaces, enables the appearance of the compact to be changed as desired by the user. To this end, the retaining structure may be such as to permit manual removal of the insert member.

The invention also embraces a compact having a base containing cosmetic material, a transparent cover, and an insert member mounted within the cover to provide an inwardly-facing mirror.

Further features and advantages of the invention will be apparent from the detailed description hereinbelow set forth, together with the accompanying drawings.

DETAILED DESCRIPTION

Figure 2:
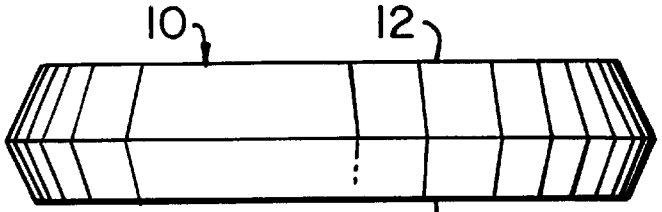
FIG. 2 is a side view of the compact of FIG. 1.

In the drawings, the invention is illustrated as embodied in a cosmetic container or container kit including a compact 10 of generally circular plan configuration, dimensioned to be held in a user's hand, for holding a cosmetic material such as powder, blush or the like for application to the face. The compact 10 includes a base 11 and a cover 12, of identical circular plan diameter (though they may differ in depth), interconnected at one edge portion by a hinge 14 and provided on an opposite edge portion with a latch 16 for holding the cover in closed position on the base. The hinge and latch may be entirely conventional in structure, function and location.

The base and cover are substantially rigid and are self-sustaining in shape. They may be fabricated in a generally conventional manner of materials conventionally used for such purposes, provided that, as hereinafter explained, the cover 12 is transparent so that the contained cosmetic material can be clearly seen, and its color correctly ascertained, when viewed through the cover from the exterior of the compact. Conveniently, the cover is a unitary, molded, transparent plastic element, and the base is molded of colored opaque plastic.

In common with conventional compacts, the base 11 constitutes a cosmetic-holding tray. To this end, the base includes an annular molded plastic element 18 fixedly mounted e.g. by snap fitting or sonic-welded assembly in the interior of the base 11 to define at least one recess 18*a*, opening upwardly within the interior of the compact, for holding a quantity of compressed powdered cosmetic material 20. Also in common with conventional compacts, the compact is ordinarily carried by the user with the cover member closed and latched over the base member so as to enclose the contained cosmetics. For applying the cosmetics, the compact is opened to expose the cosmetic-holding recess of the tray; the user then removes a portion of a the contained cosmetic material with a powder puff or like pad 22 (FIGS. 4 and 5), brush or other implement, or a finger, and applies it to her face. To facilitate such operation, the hinge permits the cover to move, in opening, through an angle of at least about 90° relative to the base; commonly, the cover is movable to a full-open position at an angle of 180° relative to the base.

The cover 12, in the form shown, has the shape of a shallow inverted pie pan, with a planar circular central portion 24 surrounded by a downwardly flaring, frusto-conical edge portion 26. Thus, the cover may be considered to have a concave (though centrally planar) inner surface facing the interior of the compact. As a particular feature of the invention, the illustrated cosmetic container or container kit includes a mirror-bearing insert member 28 (FIGS. 4–7) which, in the described embodiment, is a substantially rigid molded plastic disk dimensioned to fit within the cover, in abutting relation to (and extending over the entirety of) the planar portion of the inner surface thereof. The insert member has a rim 30 beveled to conform snugly to the interior of the frusto-conical edge portion 26 at its juncture with the planar portion 24 of the cover.

The insert member 28 has two opposed major surfaces 32 and 34 respectively facing inwardly and outwardly when the member is fitted within the cover 12. The inwardly facing surface 32 is shown as recessed over its entire area (except for a narrow peripheral portion) to receive a mirror 36, such as a conventional planar metallized glass mirror of circular outline, providing a specularly reflective surface facing inwardly with respect to the cover 12, i.e., in the customary position for a mirror mounted in the cover of a compact. Typically the mirror is permanently fixed in the recess by a suitable and e.g. conventional adhesive. The member 28 is itself opaque, and its outwardly facing surface 34 is decorative, being colored and/or patterned with a design (such as the floral pattern indicated at 38 in FIG. 7). Any desired decorating technique can be used to impart color and/or other decoration to the surface 34.

Figure 6:
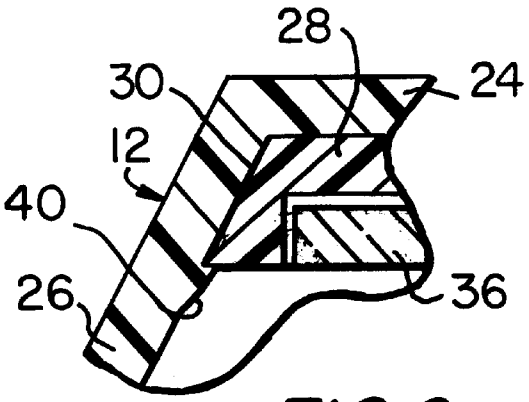
FIG. 6 is an enlarged fragmentary detail view showing the structure for retaining the mirror insert member in the compact cover.

To hold the insert member in the cover, a plurality of short circumferentially extending riblike projections 40 are molded integrally in the inner surface of the cover edge portion 26, at locations spaced around the circumference of the cover and spaced from the inner surface of central planar portion 24 by a distance corresponding to the thickness of the insert member 28. The insert member and cover, though substantially rigid as described above, are sufficiently resiliently flexible so that, when the member 28 is inserted within the interior of the cover with surface 34 facing toward the cover and pressed against the cover, its rim 30 can be forced by manual pressure past the projections 40 which then snap over the rim, securely engaging and holding the member 28 within the cover as best seen in FIG. 6. That is to say, by virtue of the shapes and relative dimensions of the cover, insert member and projections 40, the insert member can be manually snap-fitted into the interior cover with the mirror 36 facing inwardly so as to be usable when the compact is open for application of the contained cosmetic material.

Figure 4:
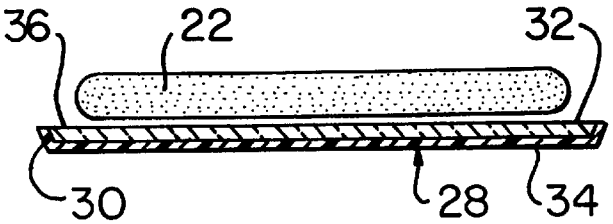
FIG. 4 is a view of the applicator and mirror insert member provided with the compact of FIG. 1 but separate therefrom when the compact is arranged for point-of-purchase display as in FIG. 3.
Figure 1:
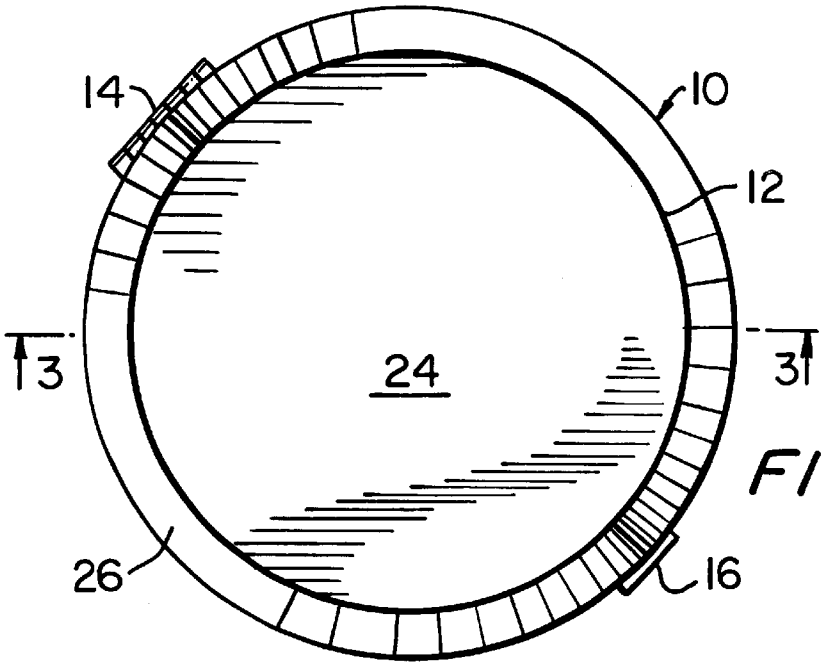
FIG. 1 is a plan view of a compact embodying the present invention in a particular form.
Figure 3:
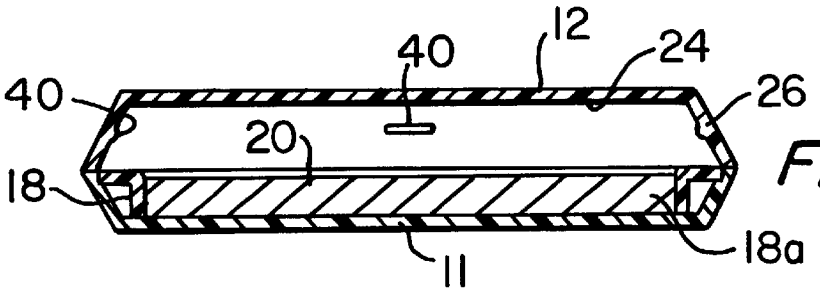
FIG. 3 is a sectional side view of the same compact, taken along the line 3—3 of FIG. 1, as initially arranged for point-of-purchase display of the contents thereof.
Figure 7:
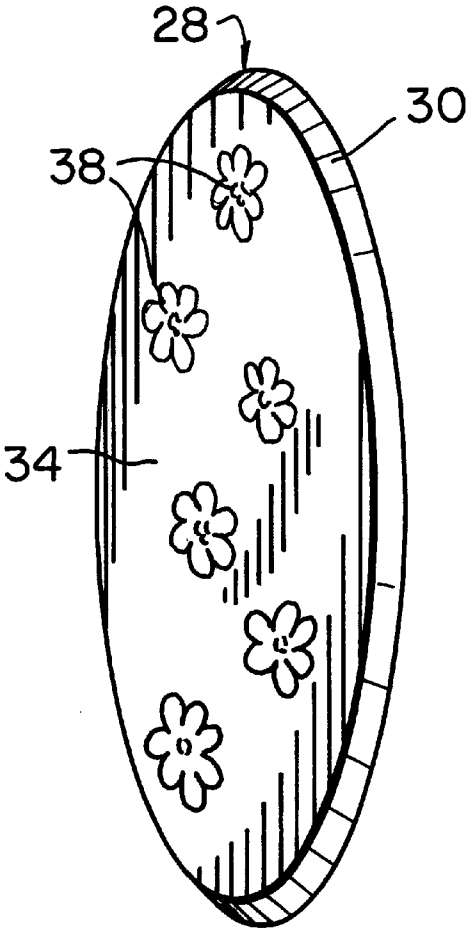
FIG. 7 is a somewhat enlarged perspective view of the mirror insert member of the compact.

As supplied by a cosmetic manufacturer to the retail market-place, the compact is provided with a body 20 of cosmetic material filling the recess 18 of the base, and the cover is in closed position, protecting the contents. At this time, the insert member 28 and applicator pad 22 are disposed outside, and conveniently beneath, the compact, being stacked (for example) as illustrated in FIG. 4 and secured to the compact by suitable packaging (not shown) such as a windowed box or transparent blister. The cosmetic material in the base is therefore visible, to prospective purchasers, through the closed transparent cover 12. In this way, effective point-of-purchase viewing of the contained cosmetic is achieved with minimal display space (because the compact is closed) and without resort to complicated and costly invertible covers or the like.

Figure 5:
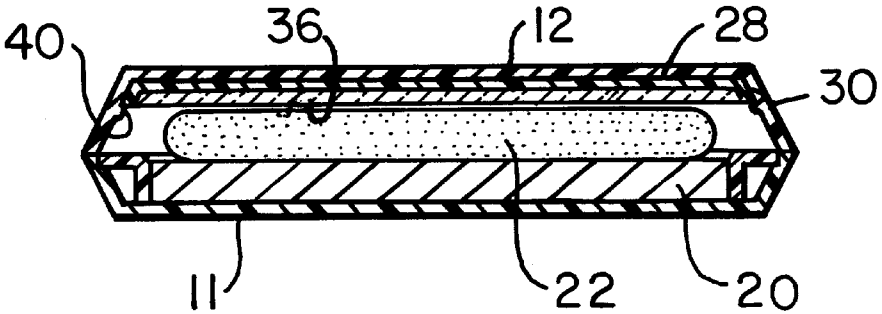
FIG. 5 is a sectional side view of the complete compact, again taken as along the line 3—3 of FIG. 1, showing the positions of the mirror insert member and applicator as assembled with the compact by a purchaser or user.

After the compact has been purchased and removed from its packaging, the user manually inserts the member 28 within the cover with the mirror facing inwardly (toward the interior of the compact), and, by manual pressure, snaps the insert into the position shown in FIG. 5, where it is thereafter securely held by the snap-fitting engagement of the insert rim with the projections 40. Owing to the opacity of the insert member, the interior of the compact is now no longer visible through the cover 12, but the decorative outer surface 34 of the insert member is visible through the cover, contributing to the aesthetic appearance of the compact and at the same time being protected by the cover from abrasion or scratching.

Figure 8:
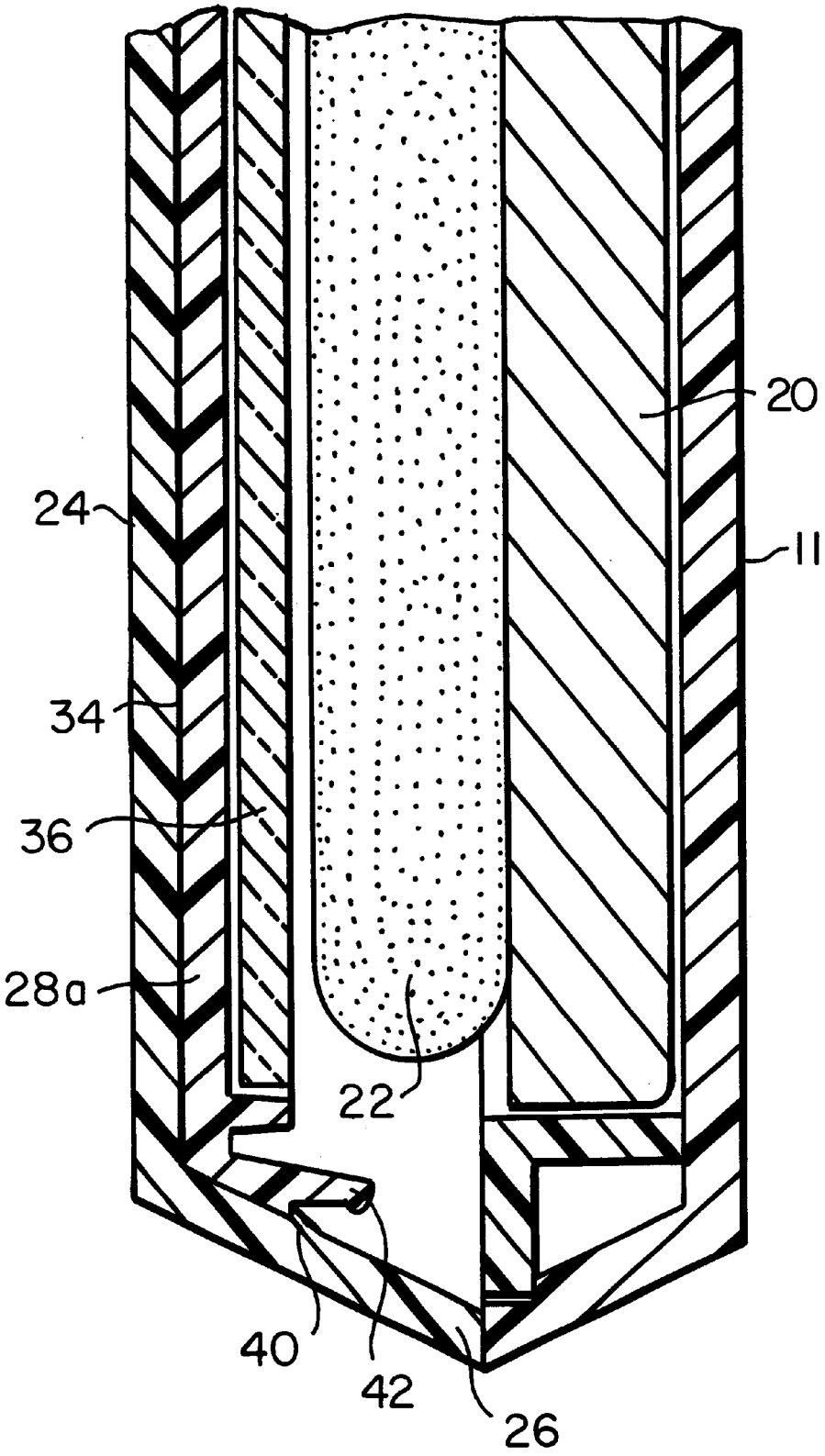
FIG. 8 is an enlarged fragmentary detail view of another embodiment of the invention.

The insert member may be left permanently in place for the life of the compact. Alternatively, as in the embodiment illustrated in FIG. 8 (wherein like reference numerals designate the same elements or features as in the previously described embodiment), any one of a plurality of insert members 28*a*, identical to each other in structure but differing in decorative appearance of the surface 34, may be used, for example to complement the user's attire or fashion accessories, one such insert member being manually removed and replaced with another in the cover as desired. Such a plurality of decoratively different mirrorbearing insert members may be packaged and sold with the compact. As in the first-described embodiment, the insert member 28*a* is snap-fitted in the cover, being held in place in the cover by a plurality of short circumferentially extending riblike projections or nibs 40 molded integrally in the inner surface of the cover edge portion 26. Appropriate structural features may be provided, e.g. a flexible latch portion 42 formed integrally in a rim portion of each insert member 28*a*, to facilitate removal of one insert member for replacement by another.

In some instances, for particular markets, it may be desired to deliver the compact with a mirror-bearing insert member already assembled by snap-fitting in the cover. The invention enables identically manufactured compacts to be selectively marketed either with or without such pre-assembly of the mirror insert in accordance with differing market preferences.

It is to be understood that the invention is not limited to the features and embodiments hereinabove specifically set forth, but may be carried out in other ways without departure from its spirit.

What is claimed is:

1. A cosmetics container kit, comprising:

(a) a compact having an exterior and an interior and including a base for containing a quantity of cosmetic material and a transparent cover through which the contained cosmetic material can be viewed, said cover having a surface facing the interior of the compact; and (b) an insert member having opposed extended surfaces and dimensioned to fit within the cover against the interior-facing surface thereof in overlying relation to a major portion of said interior-facing cover surface, one of said extended surfaces of said insert member being a specularly reflective surface, said insert member being manually mountable within the cover by a user to provide an inwardly-facing mirror for the compact.

2. A kit as defined in claim 1, wherein said insert member has a decorative surface opposed to said reflective surface so as to be visible through the cover when the insert member is mounted within the cover.

3. A kit as defined in claim 1, wherein said insert member is removably mountable within the cover, and further including a plurality of insert members, alternatively mountable within the cover and each having a specularly reflective surface and a decorative surface opposed thereto, the decorative surfaces of different ones of said plurality of insert members differing in appearance from each other.

4. A kit as defined in claim 1, further including an applicator positionable within the compact between the insert member and the contained quantity of cosmetic material when the insert member is mounted within the cover.

5. A container for cosmetics, comprising:

(a) a compact having an exterior and an interior and including a base and a cover connected together in a manner permitting relative movement of the base and cover to open and close the compact, said base comprising a tray opening toward the interior of the compact for holding a quantity of the cosmetic material, said cover being transparent to enable said quantity of cosmetic material to be viewed there-through when the compact is closed, and said cover having a surface facing the interior of the compact;

(b) an insert member, initially separate from the cover and base, having opposed extended surfaces and dimensioned to fit within the cover against the interior-facing surface thereof in overlying relation to a major portion of said interior-facing cover surface, one of said extended surfaces of said insert member being specularly reflective, said insert member being manually fittable within the cover by a user; and (c) retaining structure, including structure formed on the cover, providing snap-fitting interengagement between the insert member and the cover to hold the insert member securely within the cover when the insert member is manually fitted within the cover, with said specularly reflective surface facing the interior of the compact, whereby said specularly reflective surface constitutes a mirror, in the cover of the compact, visible when the compact is open to assist a user in the application of the contained cosmetic material.

6. A container as defined in claim 5, wherein said insert member has a peripheral edge and wherein said retaining structure comprises projections formed integrally in the cover for snap-fittedly engaging the peripheral edge of the insert member.

7. A container as defined in claim 5, wherein the other extended surface of the insert member is an opaque decorative surface visible through the transparent cover from the exterior of the compact mirror when the insert member is fitted within the cover as aforesaid.

8. A container as defined in claim 5, wherein said retaining structure comprises structure providing snap-fitting interengagement between the insert member and the cover such that the insert member is manually removable from the cover after being manually fitted within the cover as aforesaid, and is replaceable with another similar insert member having a decorative surface of appearance different from that of the first-mentioned insert member.

9. A container as defined in claim 5, further including an applicator separate from the base, cover and insert member but positionable between the insert member and the quantity of cosmetic material when the insert member is fitted within the cover as aforesaid.

10. A compact as defined in claim 6, wherein said member has an outwardly facing decorative surface visible through the cover.

11. A compact as defined in claim 7, wherein said insert member is removably mounted so as to be replaceable with another similar insert member having a decorative surface differing in appearance from that of the first-mentioned insert member.

* * * * *